US008701612B2

(12) United States Patent
Gruber

(10) Patent No.: US 8,701,612 B2
(45) Date of Patent: Apr. 22, 2014

(54) LASER IGNITION APPARATUS

(75) Inventor: Friedrich Gruber, Hippach (AT)

(73) Assignee: GE Jenbacher GmbH and Co Ohg, Jenbach (AT)

( * ) Notice: Subject to any disclaimer, the term of this patent is extended or adjusted under 35 U.S.C. 154(b) by 1485 days.

(21) Appl. No.: 12/314,668

(22) Filed: Dec. 15, 2008

(65) Prior Publication Data

US 2009/0159032 A1 Jun. 25, 2009

(30) Foreign Application Priority Data

Dec. 19, 2007 (AT) ..... A 2061/2007

(51) Int. Cl.
*F02B 19/00* (2006.01)
*F02P 23/00* (2006.01)

(52) U.S. Cl.
USPC ..... 123/143 B; 123/143 R

(58) Field of Classification Search
USPC ..... 123/143 B, 143 R; 313/118, 129, 110; 372/101, 103
See application file for complete search history.

(56) References Cited

U.S. PATENT DOCUMENTS 4,416,226 A * 11/1983 Nishida et al. ..... 123/143 B
4,422,323 A 12/1983 Linder et al.
4,434,753 A 3/1984 Mukainakano et al.
4,523,552 A * 6/1985 Mukainakano et al. .. 123/143 B
5,367,869 A * 11/1994 DeFreitas ..... 60/776
2005/0063646 A1* 3/2005 Gupta et al. ..... 385/88
2006/0132930 A1* 6/2006 Kopecek et al. ..... 359/718
2006/0243238 A1 11/2006 Anezaki et al.
2007/0064746 A1* 3/2007 Winklhofer et al. ..... 372/10
2008/0035088 A1* 2/2008 Klausner et al. ..... 123/143 B

FOREIGN PATENT DOCUMENTS

DE 10 2005 043 963 4/2006
EP 1 674 721 6/2006
EP 1 820 948 8/2007
JP 59-101585 6/1984
WO WO 2005021959 A1 * 3/2005
WO 2009/027145 3/2009

OTHER PUBLICATIONS

Machine Translation of WO 2005/021959 A1.*
Austrian Patent Office Search Report issued Jun. 23, 2008 in the Austrian priority application.
European Search Report issued Mar. 10, 2009 for the corresponding European application.
U.S. Appl. No. 11/976,749, filed Oct. 2007, Francesconi.

* cited by examiner

*Primary Examiner* — Stephen K Cronin
*Assistant Examiner* — Anthony L Bacon
(74) *Attorney, Agent, or Firm* — Wenderoth, Lind & Ponack, L.L.P.

(57) ABSTRACT

An apparatus for coupling laser light into a combustion chamber of a combustion engine includes a combustion chamber window and a structural element, wherein the combustion chamber window is releasably fixable to the structural element, wherein there is provided an optical window which is arranged at the structural element and is at least region-wise covered by the combustion chamber window.

14 Claims, 1 Drawing Sheet

LASER IGNITION APPARATUS

BACKGROUND (1) Field of the Invention

The invention concerns an apparatus for coupling laser light into a combustion chamber of a combustion engine including a combustion chamber window and a structural element, wherein the combustion chamber window is releasably fixable to the structural element. The invention further concerns a laser spark plug, a cylinder of a combustion engine and a combustion engine including an apparatus of the aforementioned kind.

(2) Description of Related Art

Laser ignition is at the present time in an intensive development phase, wherein at the present time besides the actual laser technology involved a great deal of attention is being placed on the engine aspect, in particular capability of being implemented in mass production. The principle of laser ignition is based on an intensive laser pulse being introduced into the combustion chamber of the engine and there focused on a focal point. At that focal point the intensity exceeds a threshold value which is sufficient to ignite a plasma spark. That plasma spark, in a similar fashion to the spark of conventional spark ignition, is capable of igniting a fuel-air mixture in the combustion chamber of an engine.

For use in relation to combustion engines, the laser ignition concepts which at the present time are being most intensively pursued are such that the laser pulse is generated by a solid state laser which is integrated together with the optical coupling-in and coupling-out system in a housing fixed to the cylinder head. That unit, by analogy with conventional spark ignition, is referred to as the laser spark plug. The ignition laser is generally optically pumped by a semiconductor laser connected to the laser spark plug by way of an optical fiber. The pumping operation, during which excitation of the laser-active atoms in the solid state crystal is effected until build-up and discharge of the laser pulse occurs, lasts for about 200 μs-400 μs. The ignition pulse itself lasts for a few nanoseconds.

The optical coupling-in system for coupling the laser pulse into the combustion chamber of the combustion engine comprises a suitable lens system and what is referred to as the combustion chamber window representing the last optical element before the beam passes into the combustion chamber.

The advantage of laser ignition over conventional spark ignition is inter alia that the ignition spark can be placed freely into the depth of the combustion chamber where optimum ignition conditions exist. In contrast thereto combustion initiation with conventional spark ignition takes place in the immediate proximity of the combustion chamber wall, with the flat electrodes which define the ignition spark impeding formation of the flame core. The energy of the laser spark can be greatly increased by increasing the power output of the laser system without thereby involving increased wear, as occurs for example with spark ignition due to electrode wear.

A further advantage of laser ignition is that, with increasing engine power output, the required minimum pulse energy (which is the energy of the plasma spark which is required as a minimum for ignition of the fuel-air mixture) decreases. In comparison the conventional spark ignition systems noticeably reach the system limits, at the engine power output levels which are planned in the future.

The main problems in regard to designing and mass-production implementation of laser ignition include inter alia ensuring or maintaining the optical properties of the combustion chamber window over the service life of the engine.

Especially in relation to the combustion chamber-side interface of the combustion chamber window, high thermo-chemical loadings and the deposit of solid residues from the combustion process can lead to clouding of the surface, whereby both the beam is attenuated (that is to say partly absorbed) and also it is scattered, which leads either to a considerable reduction in the energy of the plasma spark or however also failure of the plasma spark.

The above-described problem is usually combated by on the one hand providing reserves for losses and attenuation phenomena due to the service life, by means of high levels of pulse energy, and on the other hand endeavoring to achieve the effect of burning the window surface free by virtue of the high levels of pulse power. The disadvantage of those procedures lies in considerably increased costs for the high laser power output required for that purpose and the high specific loading on the optical interfaces in particular of the combustion chamber window. DE 10 2005 043 963 A1 and U.S. Pat. No. 4,422,323 describe apparatuses of the kind set forth in the opening part of this specification. In those apparatuses the combustion chamber window can be replaced.

BRIEF SUMMARY OF INVENTION

Therefore, taking the state of the art as the basic starting point, the object of the invention is to provide an apparatus of the kind set forth in the opening part of this specification, in which the stated disadvantages are reduced. In particular the invention aims to ensure that the service life of the laser light generating device is increased and the costs are kept low.

That object is attained by the features of the present invention. There is therefore provided an apparatus for coupling laser light into a combustion chamber of a combustion engine including a combustion chamber window and a structural element, wherein the combustion chamber window is releasably fixable to the structural element, which is wherein there is provided an optical window which is arranged at the structural element and is at least region-wise covered by the combustion chamber window.

A combustion chamber window which is releasably fixable to the structural element means that, upon corresponding fouling of or damage to the combustion chamber window, it can easily be replaced without the entire laser spark plug having to be replaced as hitherto. Other apparatuses in accordance with the state of the art provide that the combustion chamber window is fixedly integrated into the cylinder of a combustion chamber. With such combustion chamber windows, replacement cannot be effected at all. When using laser ignition arrangements such as laser spark plugs the entire arrangement has to be replaced if the combustion chamber window is damaged or fouled. The structural element can be interpreted for example as a kind of main body.

In accordance with the invention it is provided that an optical window is disposed in front of the combustion chamber window. In that case there is provided an optical window which is arranged on the structural element and which is at least region-wise covered by the combustion chamber window. That optical window can be particularly robust like a conventional combustion chamber window so that the releasably fixable combustion chamber window can be thinner as the apparatus or the laser light generating apparatus is primarily shielded by that optical window from the high temperatures, reactive conditions and pressures in the combustion chamber while the actual combustion chamber window now serves more to protect the optical window. The optical window represents the region at which the laser light is coupled out of the laser light generating device.

Since, as will be appreciated, an easily replaceable combustion chamber window is less expensive than the overall laser spark plug or laser ignition device, the combustion chamber window can be easily exchanged and replaced by releasing the fixing and the laser ignition device can be fitted into the engine block again.

It is desirably provided that the combustion chamber window is fixable to the structural element by means of a holding device. In that case it can desirably be provided that the cover means can be fixed to the structural element in force-locking and/or positively locking relationship by means of the holding device. A particularly simple mode of fixing can be embodied if the combustion chamber window can be screwed to the structural element by means of the holding device. For that purpose a screwthread can be provided on the structural element and a corresponding counterpart screwthread on the holding device. The screw connection represents not only one of the simplest fixing mechanisms but also the preferred one as a screw connection represents both a stable and also an easily releasable connection. Besides that however other fixing mechanisms would also be possible such as for example a bayonet fixing or latching connections in which a latching projection is provided on one part (structural element or holding device) and a receiving means for the latching projection is provided on the other part (holding device or structural element).

Desirably it is further provided that the fixing device is formed at least region-wise from metal or substantially comprises metal. It is particularly preferably provided that the combustion chamber window is releasably fixable to the holding device as in that way the combustion chamber window represents the sole replacement part while the remaining part of the holding device can be re-used. Thus the actual wearing part is reduced to an element which in the ideal case is inexpensive, comprising material which is transmissive or transparent for the laser light used.

In that respect it can be provided that the combustion chamber window is disposed in the cover means in positively locking relationship and/or in frictional relationship.

To keep down the costs for manufacture of the combustion chamber window it can be provided that the combustion chamber window, at least in the region in which laser light is passed therethrough, is made from the group comprising glass, sapphire, quartz, borosilicate glass, AlON or mixtures thereof.

It is further preferably provided that the apparatus has a laser light generating device for producing laser light. It can further be provided that the apparatus and the laser light generating device and optionally the optical window are in the form of a—preferably one-piece—laser spark plug.

The invention further concerns a laser spark plug including an apparatus of the aforementioned kind as well as a cylinder of a combustion engine including an apparatus of the aforementioned kind, wherein a part of the cylinder is formed by the structural element. In this case it can be provided that the combustion chamber window is fixable to the cylinder or cylinder head of the cylinder releasably by means of a holding element. Finally the invention concerns a combustion engine including an apparatus and/or a cylinder of the aforementioned kind.

BRIEF DESCRIPTION OF THE DRAWINGS

Further advantages and details will be apparent from the drawings and the specific description relating thereto. In the drawings.

DETAILED DESCRIPTION OF THE INVENTION

Figure 1:
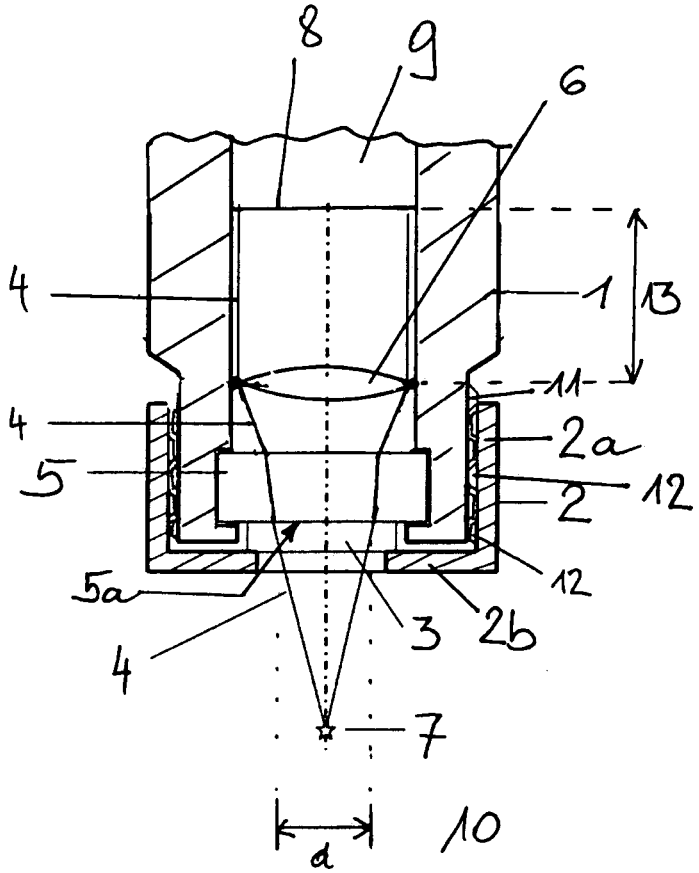
FIG. 1 shows a view in cross-section of a portion of an embodiment of an apparatus according to the invention.

The apparatus of FIG. 1 represents a preferred embodiment. The actual combustion chamber window 3 representing the last optical element before the beam entry into the combustion chamber 10 of a combustion engine is in this case releasably fixed to a structural element 1 by means of a holding device 2. The apparatus further includes a laser light generating device in the form of a laser spark plug for giving off laser light, indicated by delimitation rays 4. The holding device 2 is releasably fixed by means of a screw connection by way of a suitable screwthread 11 to the holding device 2 and a counterpart screwthread 12 to the structural element 1 or the apparatus which overall is in the form of a laser spark plug. The laser light generating device is only shown in respect of a portion thereof as it can be produced in accordance with the known state of the art. Laser light (indicated by the lateral delimitation rays 4) is passed from the resonator 9 and the coupling-out mirror 8 in the direction of the optical coupling-in system 6 which is illustrated by a lens to the optical window 5. The spacings 13 between the coupling-out mirror 8 and the optical coupling-in system 6 are in practice in the ideal case selected to be larger than indicated in FIG. 1 (and also in FIG. 2) to permit better heat distribution in the apparatus or to avoid overheating in the apparatus. In this case the optical window 5 delimits the actual laser light generating device or laser spark plug. In practice this means that for example a per se known laser spark plug which is delimited at the laser light exit surface by an optical window 5 which normally performs the function of a combustion chamber window can be used. A replaceable combustion chamber window 3 of preferably more advantageous material can then be fixed to that laser spark plug for example by way of the holding device 2, on the structural element 1. In the simplest case—as also shown in the Figure—the combustion chamber window 3 bears against the optical window 5 or the laser light exit surface 5*a* of the laser spark plug 1 as in that way the pressure in the combustion chamber 10 is transmitted to the optical window 5 (which in itself is in any case designed for such pressure loadings). At the same time the combustion chamber window 3 covers over the optical window 5 and thus prevents deposits from the combustion chamber 10 being deposited at the optical window 3.

The holding device 2 can be a cap nut. Arranged between the optical window 5 of the holding device 2 is the combustion chamber window 3 which is pressed by the cap nut against the laser light generating device or the laser light exit surface 5*a* of the optical window 5. The laser light beam path 4 is focused by the optical coupling-in system 6 onto the focal point 7 which initiates plasma ignition of a fuel-air mixture in the combustion chamber 10. Combustion of the fuel-air mixture results in formation of the typical combustion products which include for example unburnt residues which in the state of the art are deposited directly on the laser light exit surface 5*a* of the optical window 5. By interposing the separate element 3 in the region of the optical window 5, that deposit is now no longer formed directly at the optical window 5 which in the state of the art serves as the combustion chamber window but at the preceding combustion chamber window 3 which in the simplest case is made of glass. At a certain degree of fouling the laser light generating device 1 can be removed from the engine block. The holding device 2 is then removed from the laser spark plug 1 and the separate element 3 replaced. The laser spark plug which is "regenerated" in that way can then be refitted into the engine block. In that case the holding device 2 can for example comprise a main body in the form of a cylindrical casing, with holding elements for fixing to the structural element 1 in force-locking or positively locking relationship. The main body 2*a* in the form of a cylindrical casing can in that case have a support limb 2*b* which in the present case is in the form of a circular ring. It can however equally well be of different shapes. It should only be suitable for fixing an element 3 for the laser light exit surface 5*a*. What is decisive in terms of optimum functioning of the apparatus is that the optical window 5 in the region through which the laser light 4 passes and the combustion chamber window 3 in the region of the laser light exit surface d are substantially translucent for the laser light 4 of the laser light generating device 1.

By virtue of the configuration, which has proven to be highly useful in practice, of the laser spark plug in the form of a structurally integral unit from coupling-in of the pump light to coupling-in of the laser pulse into the combustion chamber, the invention makes it possible to eliminate the problem that, in the event of damage to or impairment of the surface of the combustion chamber window, the complete laser spark plug has to be replaced.

In the illustrated embodiment (FIG. 1) therefore a "protective plate portion" which is transparent for the laser light (=actual combustion chamber window) is arranged at the combustion chamber end of the combustion chamber window which at the same time represents the exit surface d of the ignition pulse from the laser spark plug 1. That protective plate portion is not fixedly connected to the laser spark plug but here is pressed by a cap nut against the optical window 5 of the laser spark plug 1.

The advantage of this proposal is that the protective plate portion 3 is simple and inexpensive to produce, and it can be easily and quickly cleaned or replaced. In addition, in terms of the choice of material for that plate portion 3, this can be limited exclusively to thermo-chemical resistance, which entails a higher optimization potential than if aspects such as thermal conduction and mechanical load-bearing capability additionally have to be considered. Likewise the thickness and the surface of the protective plate portion or protective combustion chamber window 3 can be so selected that radiation reflection is avoided as much as possible.

It should be noted at this juncture that the term of the claims "substantially transmissive for the laser light" means that slight absorption in the corresponding wavelength range signifies transmission losses of <25%, preferably <10%, particularly preferably <5%.

Figure 2:
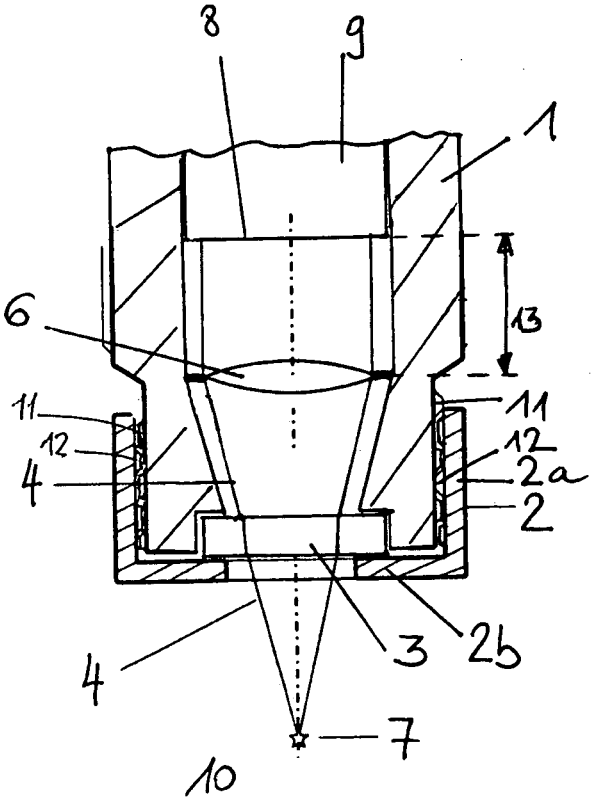
FIG. 2 shows a view in cross-section of a portion of a second embodiment.

Besides the variant shown in FIG. 1 however there is also a variant as shown in FIG. 2 in which the optical window 5 is omitted and the holding device 2 is fixed directly with the combustion chamber window 3 to the apparatus 1. It will be appreciated that in this case the combustion chamber window 3 is to be suitably dimensioned so that it withstands the conditions in the combustion chamber 10. Otherwise there is no difference worth mentioning in comparison with the FIG. 1 variant so that attention is directed to the specific description relating to FIG. 1.

The invention claimed is:

1. An apparatus for coupling laser light into a combustion chamber of a combustion engine, the apparatus comprising:

a combustion chamber window;

a structural element;

an optical window arranged at the structural element; and a holding device which holds the combustion chamber window to the structural element with a first side of the combustion chamber window pressed against the optical window, wherein the combustion chamber window is releasably fixable to the structural element, wherein an entire area of the first side of the combustion chamber window is pressed against the optical window, wherein the holding device is releasably connected to an end of the structural element, and the optical window is independently held by the structural element such that the optical window is retained in the structural element when the holding device is released from the structural element, and wherein the combustion chamber window is pressed and held against the optical window by the holding device in a manner such that the combustion chamber window is released from the structural element and the optical window when the holding device is released from the structural element.

2. The apparatus of claim 1, wherein said holding device can be fixed to the structural element in force-locking or positively locking relationship.

3. The apparatus of claim 1, wherein said holding device can be screwed onto the structural element.

4. The apparatus of claim 1, wherein said holding device is formed substantially from metal.

5. The apparatus of claim 1, wherein the combustion chamber window is formed from a material selected from the group consisting of glass, sapphire, quartz, borosilicate glass and AlON.

6. The apparatus of claim 1, wherein said combustion chamber window can be fixed to the holding device in positively locking or frictionally locking relationship.

7. The apparatus of claim 1, further comprising a laser light generating device for producing laser light.

8. A laser spark plug including the apparatus of claim 1.

9. A cylinder for a combustion engine including the apparatus of claim 1, wherein a part of the cylinder is formed by the structural element.

10. A combustion engine including the cylinder of claim 9.

11. The apparatus of claim 1, further comprising a resonator which produces light, wherein the optical window and the resonator are disposed in the structural element, and the holding device is releasably connected to the structural element.

12. The apparatus of claim 1, wherein the holding device is a cap nut screwed on to the end of the structural element.

13. A combustion engine including the apparatus of claim 1.

14. The apparatus of claim 1, further comprising a resonator which produces light, wherein a focusing lens is disposed between the optical window and the resonator.

* * * * *